US005222315A

United States Patent [19]

Lovison

[11] Patent Number: 5,222,315

[45] Date of Patent: Jun. 29, 1993

[54] PICTURE DISPLAY FRAME

[75] Inventor: Douglas I. Lovison, Carlsbad, Calif.

[73] Assignee: Signs & Glassworks, Inc., Vista, Calif.

[21] Appl. No.: 762,315

[22] Filed: Sep. 19, 1991

[51] Int. Cl.[5] ..... A47G 1/06

[52] U.S. Cl. ..... 40/159; 40/152.1

[58] Field of Search ..... 40/159, 124.2, 152, 40/152.1; 428/38

[56] References Cited

U.S. PATENT DOCUMENTS

| | | | |
|---|---|---|---|
| 859,199 | 7/1907 | Chinnery . | |
| 1,252,918 | 1/1918 | McNicholas | 40/152 X |
| 1,270,475 | 6/1918 | Wilkenson | 40/152 |
| 1,356,892 | 10/1920 | Stevens | 40/159 |
| 1,694,847 | 12/1928 | Donaldson . | |
| 1,867,314 | 7/1932 | Gurwick . | |
| 2,235,791 | 3/1941 | Wohlers . | |
| 3,587,187 | 6/1971 | Sibley | 40/159 |
| 3,686,784 | 8/1972 | Hirsch et al. | 40/159 |
| 3,805,049 | 4/1974 | Frank et al. . | |
| 3,900,641 | 8/1975 | Woodman et al. . | |
| 3,931,425 | 1/1976 | Kuroda . | |
| 4,067,129 | 1/1978 | Abramson et al. . | |
| 4,127,689 | 11/1978 | Holt . | |
| 4,500,374 | 2/1985 | Nakazima . | |
| 4,721,635 | 1/1988 | Helinski . | |
| 4,771,557 | 9/1988 | Bowman | 40/159 X |
| 4,791,010 | 12/1988 | Hanley et al. . | |
| 4,933,218 | 6/1990 | Longobardi . | |
| 4,947,566 | 8/1990 | Hoebel | 40/152.1 X |
| 4,952,462 | 8/1990 | Bright . | |
| 5,010,672 | 4/1991 | Coleman | 40/615 |

FOREIGN PATENT DOCUMENTS

| | | |
|---|---|---|
| 0298687A2 | 7/1988 | European Pat. Off. . |
| 3247964A1 | 7/1984 | Fed. Rep. of Germany . |

*Primary Examiner*—Kenneth J. Dorner
*Assistant Examiner*—J. Bonifanti
*Attorney, Agent, or Firm*—Nydegger & Associates

[57] ABSTRACT

A picture display includes a clear substrate and a sealing sheet which holds a masking liner against the substrate to create a pocket between the substrate and the liner. A picture is insertable into the pocket where it can be held for display through the clear substrate. In the manufacture of the picture display, an ink deposit is placed around the border of the substrate and this deposit is then held between the substrate and the sealing sheet. This creates a framing effect for any picture which is placed in the pocket. Further, the sealing sheet is formed with a slit which provides access into the pocket. Still further, a portion of the substrate can be heat formed to create a stand for the picture display.

12 Claims, 1 Drawing Sheet

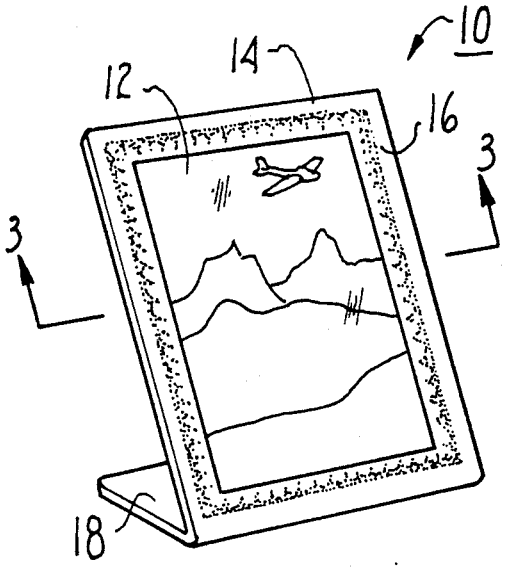
Fig. 1
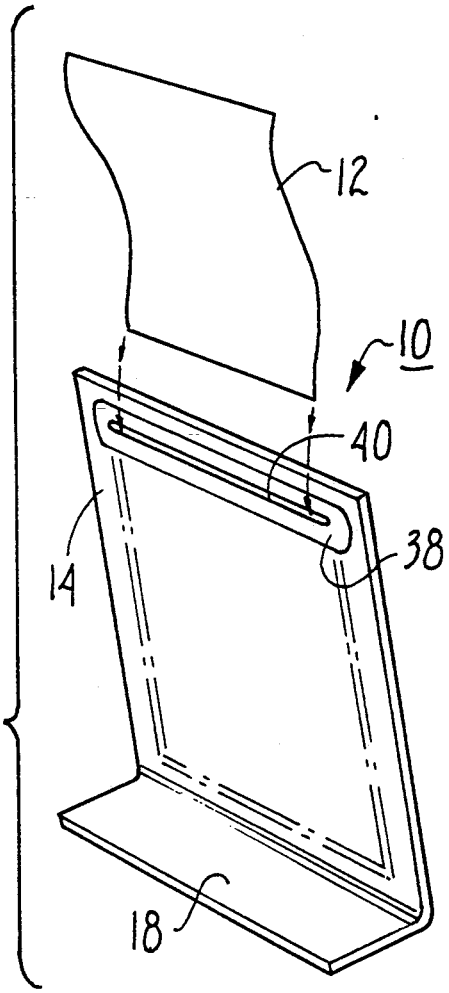
Fig. 4
Fig. 2
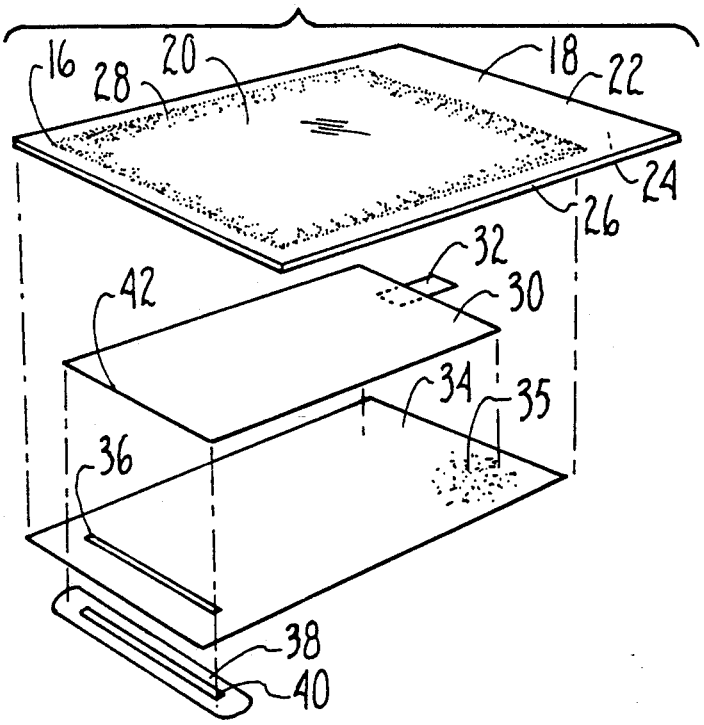
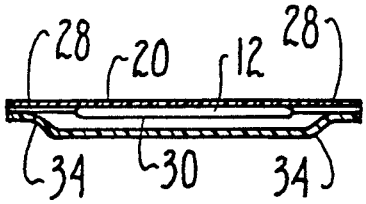
Fig. 3

PICTURE DISPLAY FRAME

FIELD OF THE INVENTION

The present invention pertains to picture display frames. More specifically, the present invention pertains to picture frames which are of unitary construction. The present invention is particularly, but not exclusively, useful for the display of single sheet pictures, such as advertising layouts, which may need to be periodically changed.

BACKGROUND OF THE INVENTION

Various structures for displaying and protecting pictures have been proposed over the years. The typical picture frame is, of course, very well known and can vary in appearance from a rather simple and unattractive support structure for the picture to a very ornate and expensive piece of work which may be considered to be art in its own right. Such frames are particularly well suited for the formal or informal display of a picture or painting. They do, however, tend to be somewhat bulky, and once the picture has been placed in the frame, it is not always an easy matter to replace the picture. Indeed, there are many situations or circumstances wherein a standard picture frame is not the answer. Such a frame may be too expensive or too permanent in nature for the intended display.

Although functionality may be the primary consideration for many commercial uses, particularly where cost considerations can be determinative, there is still a need to both protect and attractively present a picture. In such situations there may be a need for something other than a standard picture frame.

One alternative to a standard picture frame is plastic lamination. Indeed, many methods are known for producing support structures for pictures whereby the picture is protected by bonding the picture between laminated plastic sheets. Further, if lamination is considered too permanent, the picture can be placed into the pocket of a specially manufactured plastic insert. Laminated pictures and pictures placed in plastic inserts, however, are generally very temporary in nature and typically do not present the picture in a very attractive manner.

In many commercial applications it is desirable or necessary to economically present a picture in an attractive display. Such applications may require a sophisticated effect which is typically obtained using an elegant standard type picture frame. Unfortunately, the costs required to achieve these results using standard type picture frames can be prohibitive.

In light of the above it is an object of the present invention to provide a picture display which is attractive. Another object of the present invention is to provide a method for manufacturing a picture display which allows the picture display to be specially manufactured, and thereby specifically attractive, for a particular use. Still another object of the present invention is to provide a picture display which permits an easy exchange of pictures which are supported or held by the picture display. Yet another object of the present invention is to provide a picture display which is relatively easy to manufacture and comparatively cost effective.

SUMMARY OF THE INVENTION

A picture display, in accordance with the present invention, includes a support structure which is formed as a pocket between a first and a second panel. Specifically, a clear, semi-rigid and substantially flat plastic substrate is used as the first panel, and this first panel is joined to the second panel at their respective peripheries. An ink deposit is placed on the first panel, between the first and second panels and preferably near the periphery of the first panel, to give a framed effect for whatever picture is placed in the pocket.

The second panel, as used for the picture display of the present invention, includes a masking liner and an adhesive sealing sheet which adheres to the masking liner and to the first panel to hold the masking liner against the first panel. As intended for the present invention, the adhesive sealing sheet extends beyond the periphery of the masking liner to adhere to the first panel along their respective peripheries. Consequently, by using either a clear or colored metalized film as the sealing sheet, the metalized film can enhance the ornamental aspects of the ink deposit on the first panel to accentuate the frame effect of the picture display.

Easy access into the pocket of the picture display, for easy exchange and replacement of pictures, is provided by a slit which is formed through the sealing sheet along a portion of the periphery of the masking liner. Additionally, a reinforcing strip can be placed around the slit to inhibit tearing of the second panel during replacement of pictures in the picture display.

The novel features of this invention, as well as the invention itself, both as to its structure and its operation will be best understood from the accompanying drawings, taken in conjunction with the accompanying description, in which similar reference characters refer to similar parts, and in which:

BRIEF DESCRIPTION OF THE DRAWINGS

FIG. 1 is a perspective view of the picture display of the present invention as seen from the left front;

FIG. 2 is an exploded view of the picture display;

FIG. 3 is a cross-sectional view of the picture display as seen along the line 3—3 in FIG. 1; and FIG. 4 is a perspective view of the picture display of the present invention as seen from the left rear with a picture ready to be placed into the picture display.

DESCRIPTION OF THE PREFERRED EMBODIMENTS

Referring initially to FIG. 1, the picture display of the present invention is shown and generally designated 10. In use, the display 10 presents a picture 12 which is held by a support portion 14 of the display 10. As will be readily appreciated, the picture 12 can be any visual presentation desired by the user. For example, the display 10 can be used for personal purposes or for commercial purposes such as advertising. FIG. 1 also shows that the support 14 can include a frame 16 which surrounds the picture 14 to provide ornamental aspects for the display 10. Further, FIG. 1 shows that the display 10 can include a stand 18 which extends at an angle from the support 14 to allow presentation of the picture 14 in the display 10 on a table top or some other flat horizontal surface (not shown).

In FIG. 2 the components of the display 10 are shown in an exploded perspective in the relative order in which they are to be combined. Specifically, it is seen in FIG. 2 that the display 10 first includes a first side panel or substrate 20. This substrate 20 is preferably a clear semi-rigid plastic of any type well known in the pertinent art. For most applications, the substrate 20 is preferably made of a PETG plastic. Further, it is seen that the substrate 20 has a first side 22 and a second side 24 with an edge 26 therebetween. For the purposes of the present invention, an ink deposit 28 can be placed as desired on the second side 24 of substrate 20. As best seen in FIGS. 1 and 2, the ink deposit 28 is placed around the periphery of substrate 20 near the edge 26 to create the frame 16. This particular placement of the ink deposit 28 provides a framed effect for the picture 12 which is intended to enhance and compliment the presentation of the picture 12. In accordance with the present invention, the ink which is used for ink deposit 28 in the creation of frame 16 can be of any color and of any type well known in the pertinent art. Also, although the ink deposit 28 is shown in the Figures to be placed near the edge 26 of substrate 20 in order to provide a frame effect for the picture 12, it is to be appreciated that the ink deposit 28 can be placed anywhere on the second side 24 of substrate 20. Indeed, the exact location of ink deposit 28 on second side 24 and its configuration or design on the second side 24 of substrate 20 is entirely discretionary.

FIG. 2 also shows that the stand 18 is preferably an extension of the substrate 20. As intended for the present invention, stand 18 is an integral part of the substrate 20 which extends beyond the frame 16 substantially as shown. This allows the stand 18 to be thermoformed, or otherwise bent, into the configuration for display 10 as shown in FIG. 1. On the other hand, for some applications the stand 18 can be completely eliminated. Such would be the case where it is desired to hang the display 10 from a wall or some other vertical surface (not shown).

A masking liner 30 is shown in FIG. 2 to be positioned for placement against the second surface 24 of substrate 20. As intended for the present invention, masking liner 30 can be made of a cardboard material or any other light weight and relatively inexpensive material which will provide some rigidity. During the manufacture of display 10, a tape 32 can be used to stationarily hold the masking liner 30 against as a metalized film 34 is adhered to both the masking liner 30 and the substrate 20.

As shown in FIG. 2 a second side panel or metalized film 34 is positioned to place the masking liner 30 between the metalized film 34 and the substrate 20. The metalized film 34 may be of any color and of any type well known in the pertinent art. Importantly, the metalized film 34 includes an adhesive 35 on its side which will come into contact with the masking liner 30 and the substrate 20. Adhesive 35 is preferably a temperature or pressure sensitive adhesive. Accordingly, metalized film 34 operates as a sealing sheet and hold masking liner 30 against the substrate 20 to create a pocket therebetween into which the picture 12 can be placed. FIG. 2 also shows that metalized film 34 is formed with a slit 36 and that the display 10 also includes a reinforcing strip 38 which is formed with a slit 40. As intended for the present invention, the slit 36 in metalized film 34 and the slit 40 in reinforcing strip 40 are aligned with the edge 42 of masking liner 30. This alignment allows for access to the pocket formed between substrate 20 and masking liner 30 when the metalized film is adhered to the masking liner 30 and the substrate 20. As will be appreciated by the skilled artisan, the reinforcing strip can be made of any suitable material, such as a plastic, which can be attached to the metalized film 34.

FIG. 3 shows the relative position of the display frame 10 when the picture 12 has been inserted into the pocket between substrate 20 and the masking liner 30. Additionally, FIG. 3 shows that the ink deposit 28 can be positioned so that the ink deposit 28 and the metalized film 34 will act together to create the desired ornamental effect for the display 10. FIG. 4 indicates that a picture 12 can be positioned through the slits 36 and 40 to position the picture 12 in the pocket between the substrate 20 and the masking liner 34.

In the manufacture of the display 10 it is to be appreciated that a plurality of displays 10 can be manufactured simultaneously. Though not shown, it will be readily appreciated that a sheet of plastic PETG can be cut into a plurality of displays 10. Consequently, it can be appreciated that by using properly dimensioned materials, a plurality of masking liners 30 can be positioned within a plurality of frames 16 which have been created on the plastic sheet. A metalized film 34 can then be positioned over these components and the resultant combination cut to create a plurality of displays 10. The slits 36 and 40 can then be cut into the metalized film 34 and the substrate 20 and, if desired, the stands 18 can then be thermoformed to create the displays 10 as shown in FIGS. 1 and 4. More specifically, a method for manufacturing a picture display 10 includes providing a clear, substantially flat, semi-rigid substrate 20 on which a deposit of ink 28 is placed to create a plurality of framed areas on the substrate 20. A plurality of paper masking liners 30 are then taped to the substrate 20 to position each of the masking liners 30 within a framed area. Next a metalized film 34 is adhered or attached to the substrate 20 with each of the masking liners 30 positioned between the metalized film 34 and the substrate 20 to create a plurality of pockets which are individually defined by a masking liner 30 and the substrate 20. The metalized film 34 is then die cut at a plurality of locations on the film 34 to form a slit 36/40 for access into each of the pockets. The entire combination is then die cut to create a plurality of individual said picture displays 10. If desired, the substrate 20 can then be thermoformed to establish a stand 18 for each individual picture display 10 and a reinforcing strip 38 can be positioned in a surrounding relationship to each of the slits 36/40.

While the particular picture display frame as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. A picture display which comprises:

a clear, substantially flat, substrate having a first surface and a second surface with an edge therebetween;

a deposit on portions of said second surface to create a frame effect for said picture, said deposit being positioned near said edge;

a masking liner having a periphery, said masking liner being disposed against said second surface of said substrate to partially cover said substrate; and a sealing sheet adhesively attached to said masking liner and to a portion of said second surface of said substrate for holding said masking liner against said substrate to establish a pocket therebetween, said sealing sheet being formed with a slit at the periphery of said masking liner to provide an access to said pocket for insertion of said picture into said pocket.

2. A picture display as recited in claim 1 further comprising a reinforcing strip attached to said sealing sheet in a surrounding relationship to said slit to inhibit tearing of said sealing sheet.

3. A picture display as recited in claim 2 wherein said substrate is made of plastic.

4. A picture display as recited in claim 3 wherein said sealing sheet is a metalized film.

5. A picture display as recited in claim 4 wherein said deposit is a colored ink.

6. A picture display as recited in claim 1 further comprising a pressure sensitive adhesive for attaching said sealing sheet to said masking liner and to said substrate.

7. A picture display as recited in claim 1 further comprising a temperature sensitive adhesive for attaching said sealing sheet to said masking liner and to said substrate.

8. A picture display as recited in claim 1 further comprising a tape for prepositioning said masking liner against said second surface of said substrate.

9. A picture display which comprises:

a support formed as a pocket for receiving and holding said picture therein, said support including a first side panel having a periphery and a second side panel having a periphery, said first and second side panels being joined together along their respective peripheries to form said pocket, and wherein and said second side panel is formed with a slit to provide an access for insertion of said picture into said pocket and wherein said first side panel is a clear, semi-rigid, substantially flat plastic substrate, and said second side panel comprises a masking liner having a periphery and a sealing sheet formed with said slit, said sealing sheet being adhesively attached to said masking liner with said slit aligned along said periphery and said masking liner positioned on said sealing sheet to leave a remainder portion of said sealing sheet for adhesively attaching said sealing sheet to said first side panel;

a reinforcing strip attached to said second side panel in a surrounding relationship to said slit to inhibit tearing of said second side panel; and a deposit placed between said first side panel and said second side panel where said first and second side panels are joined together to create a frame effect around said pocket.

10. A picture display as recited in claim 9 further comprising a pressure sensitive adhesive for attaching said first side panel to said second side panel.

11. A picture display as recited in claim 9 further comprising a temperature sensitive adhesive for attaching said first side panel to said second side panel.

12. A picture display as recited in claim 9 further comprising a tape for prepositioning said masking liner against said first side panel.

* * * * *